US008033143B2

(12) United States Patent
Kim et al.

(10) Patent No.: US 8,033,143 B2
(45) Date of Patent: Oct. 11, 2011

(54) WASHING MACHINE

(75) Inventors: Tae Kil Kim, Sancheong-gun (KR); Jae Han Lim, Suwon-si (KR); Seong Kwun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 257 days.

(21) Appl. No.: 12/368,640

(22) Filed: Feb. 10, 2009

(65) Prior Publication Data

US 2009/0211035 A1 Aug. 27, 2009

(30) Foreign Application Priority Data

Feb. 25, 2008 (KR) ..... 10-2008-0016693

(51) Int. Cl.
*D06F 33/02* (2006.01)

(52) U.S. Cl. ..... 68/12.16; 68/131; 68/133

(58) Field of Classification Search ..... 68/131, 68/133

See application file for complete search history.

(56) References Cited

U.S. PATENT DOCUMENTS

| | | | | |
|---|---|---|---|---|
| 4,317,343 | A * | 3/1982 | Gerry | 68/23.7 |
| 5,176,012 | A * | 1/1993 | Oh et al. | 68/21 |
| 5,509,284 | A * | 4/1996 | Hauser | 68/23.7 |
| 5,611,221 | A * | 3/1997 | Tremel | 68/133 |
| 6,244,078 | B1 * | 6/2001 | Thompson et al. | 68/23.7 |
| 6,860,124 | B1 * | 3/2005 | Abi-Habib et al. | 68/23.7 |
| 7,028,512 | B2 * | 4/2006 | Chang | 68/53 |

FOREIGN PATENT DOCUMENTS

| | | | |
|---|---|---|---|
| JP | 05-123478 | * | 5/1993 |
| JP | 11-244577 | * | 9/1999 |
| KR | 2001-0003125 | | 1/2001 |
| KR | 2001-0097203 | | 11/2001 |
| KR | 2003-0034364 | | 5/2003 |
| KR | 10-2004-0104979 | | 12/2004 |

* cited by examiner

*Primary Examiner* — Frankie L Stinson
(74) *Attorney, Agent, or Firm* — Staas & Halsey LLP

(57) ABSTRACT

A washing machine includes a dehydrating tub which is rotatably mounted, a pulsator which is rotatably mounted in the dehydrating tub, a motor which rotates the dehydrating tub and the pulsator, a washing shaft which transmits a rotational force of the motor to the pulsator, a dehydrating shaft which intermittently transmits the rotational force of the washing shaft to the dehydrating shaft, and a power transmission device which is moved according to rotation of the washing shaft.

14 Claims, 6 Drawing Sheets

WASHING MACHINE

CROSS-REFERENCE TO RELATED APPLICATIONS

This application claims the benefit of Korean Patent Application No. 2008-0016693, filed on Feb. 25, 2008, in the Korean Intellectual Property Office, the disclosure of which is incorporated herein by reference.

BACKGROUND

1. Field

The present invention is a washing machine, and more particularly to a washing machine with a power transmission device to intermittently control power transmission between a washing shaft and a dehydrating shaft according to a rotated position of the washing shaft.

2. Description of the Related Art

Generally, a washing machine is an apparatus which washes laundry by performing a washing cycle, a rinsing cycle and a dehydrating cycle while rotationally operating a dehydrating tub mounted in a water tub, and a pulsator. In such a washing machine, the dehydrating tub is mounted in the water tub that holds wash water therein, and the pulsator is mounted to a lower part of the dehydrating tub to agitate the laundry and the wash water in the dehydrating tub.

In addition, a driving motor and a power transmission device are further included in a washing machine. The driving motor is mounted to a lower part of the water tub. The power transmission device is provided to transmit a rotational force of the driving motor to the dehydrating tub and the pulsator.

An example of the washing machine with a power transmission device is disclosed in KR Patent Laid-open No. 2003-34364. According to the disclosure, the power transmission device is equipped with a float such that power transmission to a pulsator and a dehydrating tub can be intermittently controlled according to the operation of the float by buoyancy of the wash water held in the water tub.

Furthermore, KR Patent Laid-open No. 2004-104979 discloses another example of a washing machine equipped with another type of the power transmission device. According to this reference, the power transmission device controls the power supply, being driven by a clutch motor dedicatedly provided beside the driving motor.

However, the above conventional power transmission devices of the washing machine have the following problems.

First, the power transmission device in the first example uses buoyancy of the wash water as a rotational force to operate the power transmission device. Therefore, since the power transmission can be controlled in accordance with water supply performed by the water tub without a dedicated power source, the structure is simplified. Nevertheless, the volume of a dehydrating tub should be increased compared to the capacity of the washing machine in order to generate an air layer in the water tub. Furthermore, a sufficient space needs to be secured between the water tub and the dehydrating tub for vertical movements of the dehydrating tub in the space. Accordingly, consumption of water is greatly increased.

Second, the power transmission device using the clutch motor of the second example guarantees high reliability of the power transmission control. However, since a complicated mechanical structure including the dedicated clutch motor is required, the production cost is increased.

SUMMARY

Accordingly, it is an aspect of the present invention to solve the above problems. It is another aspect of the present invention to provide a washing machine equipped with a power transmission device capable of reducing the production cost thereof by saving a dedicated electric device to control power transmission.

It is another aspect of the invention to provide a washing machine capable of improving reliability of the power transmission control and reducing waste of space in a water tub.

Additional aspects and/or advantages of the invention will be set forth in part in the description which follows and, in part, will be apparent from the description, or may be learned by practice of the invention.

The foregoing and/or other aspects of the present invention are achieved by providing a washing machine including a dehydrating tub; a pulsator which is rotatably mounted in the dehydrating tub; a motor which rotates the dehydrating tub and the pulsator; a washing shaft which transmits a rotational force of the motor to the pulsator; a dehydrating shaft which intermittently receives the rotational force of the washing shaft; and a power transmission device which is moved according to the rotation of the washing shaft, thereby controlling intermittent power transmission between the washing shaft and the dehydrating shaft.

The washing machine may further include a pair of first guide grooves and second guide grooves which are respectively formed at the washing shaft and the dehydrating shaft so as to guide movement of the power transmission member.

The length of an overlapped part between the first guide groove and the second guide groove may be varied according to rotated positions of the washing shaft and the dehydrating shaft. The power transmission device may intermittently control power transmission between the washing shaft and the dehydrating shaft according to the overlapped length.

The power transmission device may transmit the rotational force of the washing shaft to the dehydrating shaft when the overlapped length of the guide grooves is minimized, and does not transmit the rotational force when the overlapped length is beyond the minimum degree.

The first guide groove and the second guide groove may each include a first stopper and a second stopper formed at both ends thereof, and the power transmission device may transmit the rotational force of the washing shaft to the dehydrating shaft when disposed between any one stopper of the first guide groove and any one stopper of the second guide groove.

The washing shaft and the dehydrating shaft may include a first power transmission unit and a second power transmission unit, respectively, the first and second power transmission units both having a flange form and facing each other, and the first guide groove and the second guide groove may be disposed at facing surfaces of the first power transmission unit and the second power transmission unit.

The first guide groove and the second guide groove may have an arc shape.

The dehydrating shaft may include a pair of stoppers, and the power transmission member transmits the rotational force of the washing shaft to the dehydrating shaft when the washing shaft is rotated with the power transmission member restricted by any one of the stoppers, and does not transmit the rotational force when the washing shaft is rotated with the power transmission member separated from the stoppers.

The power transmission member may have a spherical shape.

The foregoing and/or other aspects of the present invention are achieved by providing a washing machine including a dehydrating tub; a pulsator which is rotatably mounted in the dehydrating tub; a dehydrating shaft connected to the dehydrating tub; a driving motor which generates a rotational force; and a power transmission device which includes a washing shaft connected between the driving motor and the pulsator and the dehydrating shaft, and to connect the washing shaft with the dehydrating shaft according to unidirectional rotation of the washing shaft.

The power transmission device may include a first guide groove and a second guide groove respectively formed at the washing shaft and the dehydrating shaft, and a power transmission member which is received in a space formed between the first and the second grooves corresponding to each other and is moved according to the unidirectional rotation of the washing shaft, thereby connecting the washing shaft with the dehydrating shaft.

The first guide groove and the second guide groove each may include a first stopper and a second stopper formed at both ends thereof, and the power transmission device transmits the rotational force of the washing shaft to the dehydrating shaft when disposed between any one stopper of the first guide groove and any one stopper of the second guide groove by the unidirectional rotation of the washing shaft.

The washing shaft and the dehydrating shaft include a first power transmission unit and a second power transmission unit, respectively, the first and second power transmission units both having a flange form and facing each other, and the first guide groove and the second guide groove are disposed at facing surfaces of the first power transmission unit and the second power transmission unit.

The foregoing and/or other aspects of the present invention are achieved by providing a washing machine including a dehydrating tub; a pulsator which is rotatably mounted in the dehydrating tub; a driving motor which generates a rotational force; a power transmission device which includes a washing shaft connected between the driving motor and the pulsator and a dehydrating shaft connected to the dehydrating tub, and connects the washing shaft with the dehydrating shaft according to a unidirectional rotation of the washing shaft; and a control unit which controls the driving motor such that the power transmission between the washing shaft and the dehydrating shaft is intermittently controlled according to the rotation of the washing shaft.

The power transmission device may interrupt the power transmission when the washing shaft is rotated within a predetermined rotatable range, and transmits the rotational force from the washing shaft to the dehydrating shaft when the washing shaft is rotated in one direction beyond the rotatable range.

The control unit may control the driving motor such that the washing shaft is rotated clockwise and counterclockwise within the rotatable range.

The control unit may control the driving motor such that the washing shaft is rotated in one direction beyond the rotatable range.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF EMBODIMENTS

Figure 1:
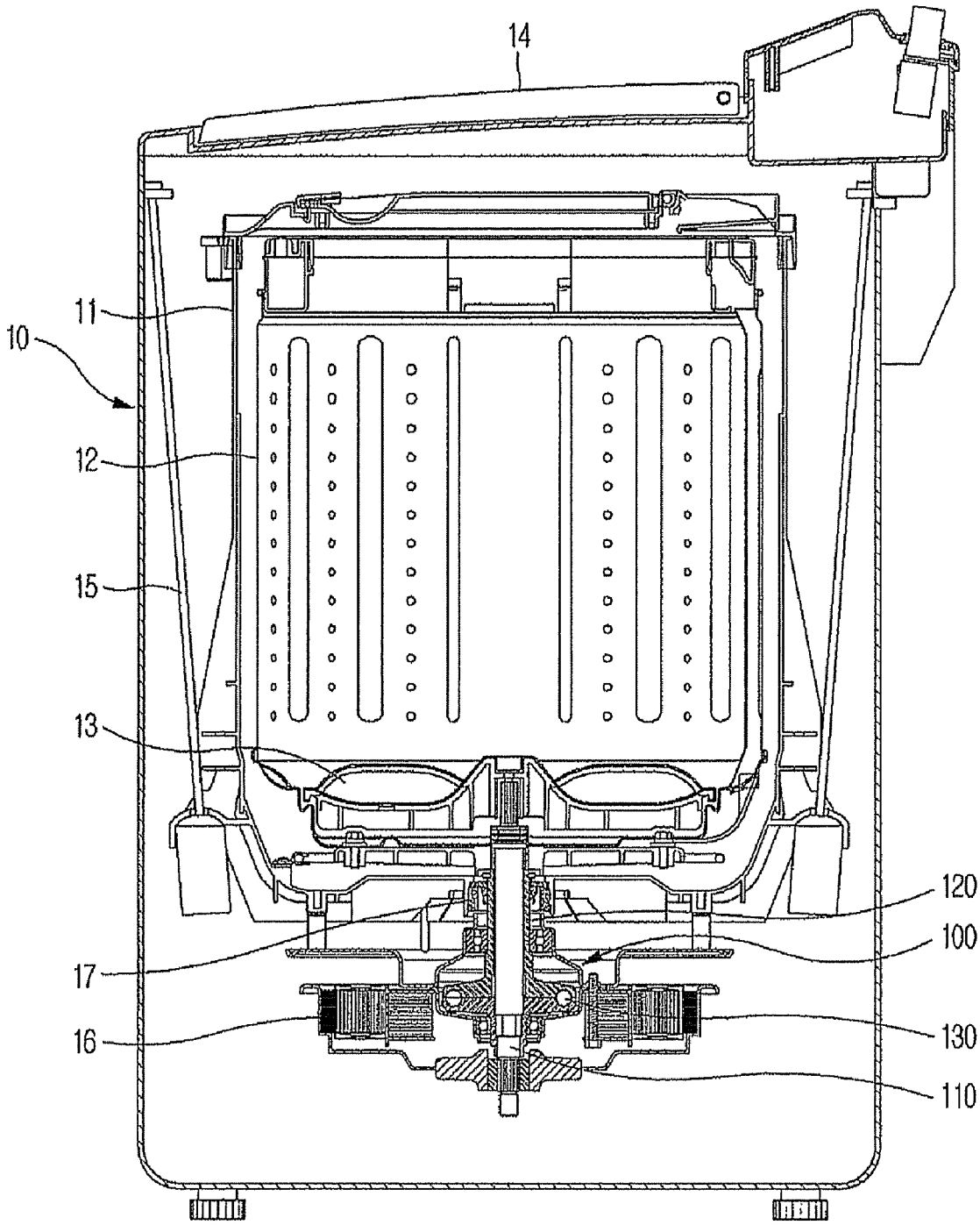
FIG. 1 is a sectional view showing an inner structure of a washing machine according to an embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

A washing machine according to an embodiment of the present invention includes a water tub 11 mounted in a main case 10, a dehydrating tub 12 rotatably mounted in the water tub 11, and a pulsator 13 rotatably mounted at a lower part inside the dehydrating tub 12.

A door 14 is pivotably mounted at an upper part of the main case 10. The water tub 11 is supported by a plurality of suspension systems 15 mounted between an inner upper part of the main case 10 and a lower part of the water tub 11.

Additionally, a driving motor 16 is provided at a lower part of the water tub 11 to operate the pulsator 13 and the dehydrating tub 12. Also, a power transmission device 100 is provided to transmit a rotational force of the driving motor 16 to the pulsator 13 and the dehydrating tub 12.

Here, the driving motor 16 may be a brushless direct current (BLDC) motor capable of conveniently controlling the rotational direction and rpm thereof. Therefore, the driving motor 16 is able to rotate clockwise and counterclockwise.

The power transmission device 100 includes a washing shaft 110 rotating the pulsator 13, a dehydrating shaft 120 formed with a central cavity 121 for engagement with an outer circumference of the washing shaft 110, power transmission units 112 and 122 controlling power transmission between the washing shaft 110 and the dehydrating shaft 120, and a power transmission member 130 interposed between the two power transmission units 112 and 122.

The washing shaft 110 is directly connected to the driving motor 16 and the pulsator 13, penetrating the water tub 11. The dehydrating shaft 120, also penetrating the water tub 11, is connected to the dehydrating tub 12. Between the dehydrating shaft 120 and the water tub 11, a sealing member 17 is interposed to prevent leakage of water.

Figure 2:
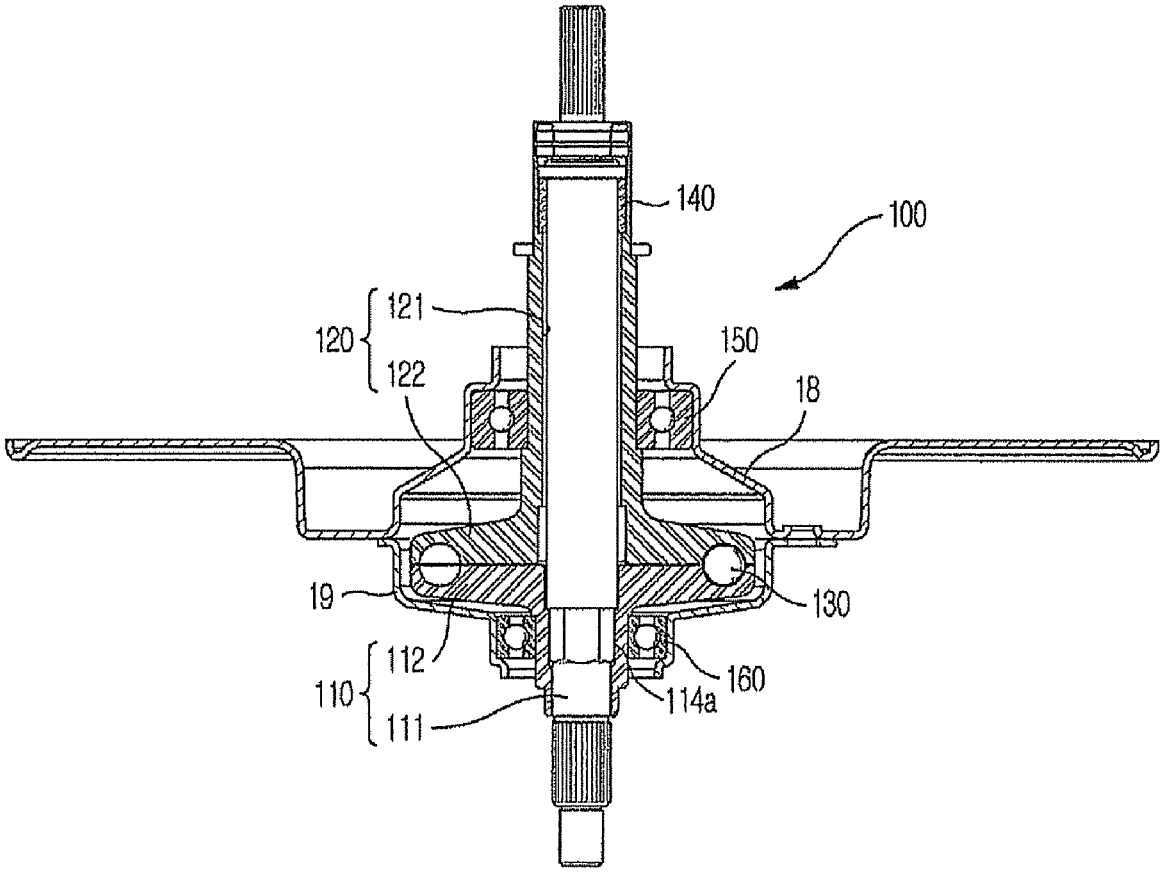
FIG. 2 is an enlarged sectional view showing a power transmission device of FIG. 1.

The structure of the power transmission device 100 will be described in greater detail with reference to FIG. 2. The dehydrating shaft 120 includes the central cavity 121 formed in an axial direction thereof. The washing shaft 110 is inserted in the central cavity 121, penetrating the dehydrating shaft 120 in the axial direction, and therefore connected between the driving motor 16 (FIG. 1) and the pulsator 13 (FIG. 1). An oilless bearing 140, which is capable of operating without oil supply, is further interposed between the dehydrating shaft 120 and the washing shaft 110 so as to support the washing shaft 110 rotatably.

Also, upper and lower frames 18 and 19 are mounted to a lower part of the water tub 11 (FIG. 1). A first bearing 150 is interposed between the upper frame 18 and the dehydrating shaft 120 to rotatably support the dehydrating shaft 120. A second bearing 160 is interposed between the lower frame 19 and the washing shaft 110 to rotatably support the washing shaft 110.

The washing shaft 110 includes the first power transmission unit 112 having a flange form. The dehydrating shaft 120 includes the second power transmission unit 122 of a flange form at a lower part thereof.

The first and the second power transmission units 112 and 122 are disposed to face each other with respect to an axial direction of the washing shaft 110 and the dehydrating shaft 120. Here, the power transmission units 112 and 122 may be disposed in contact with or adjacent to each other so that they can move relative to each other. In addition, the first and the second power transmission units 112 and 122 include a first guide groove 113 and a second guide groove 123, respectively, which are disposed corresponding to each other. Those two guide grooves 113 and 123 define one space, so that the power transmission member 130 is received in the space.

Figure 3:
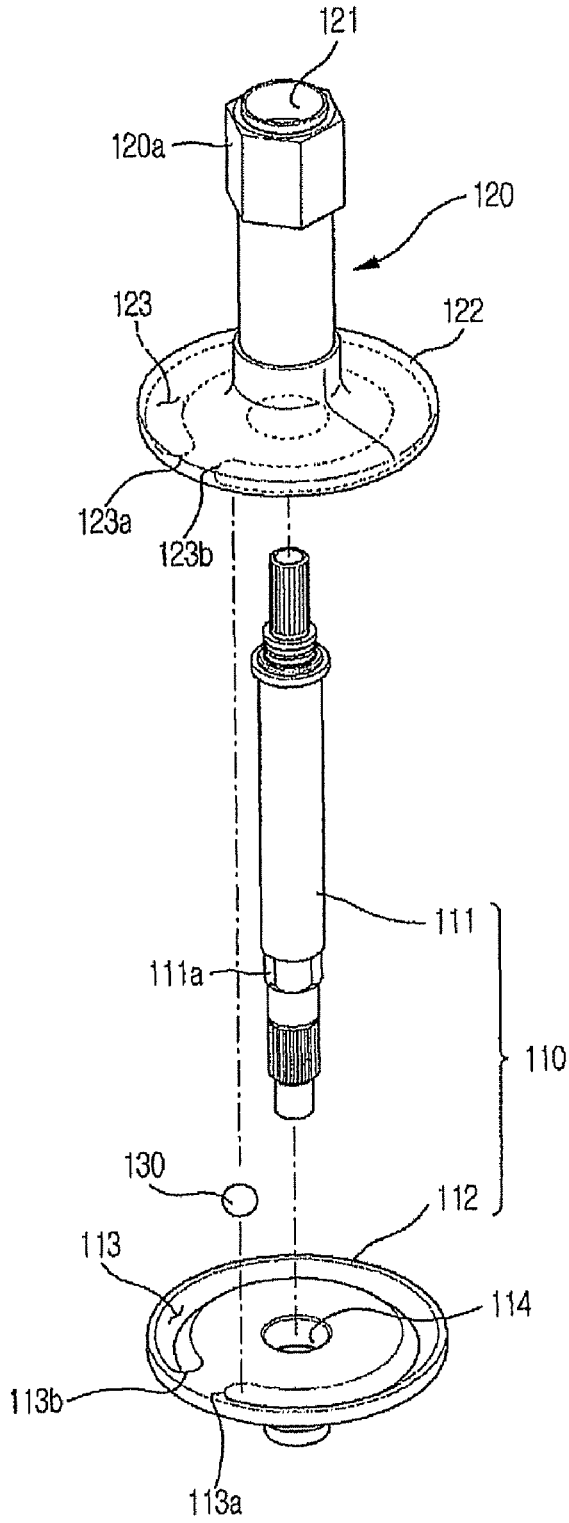
FIG. 3 is an exploded perspective view of the power transmission device of FIG. 1.

Referring to FIG. 3, the washing shaft 110 includes a shaft unit 111 including a rotating shaft, and the first power transmission unit 112 connected with an outer circumference of the shaft unit 111. The shaft unit 111 can be connected with the first power transmission unit 112 by penetrating a center hole 114 formed in the center of the shaft unit 111. A key 111 a and a key recess 114*a* (FIG. 2) are formed on the outer circumference of the shaft unit 111 and in the center hole 114 of the first power transmission unit 112, respectively, such that the rotational force can be transmitted from the shaft unit 111 to the first power transmission unit 112.

Although the shaft unit 111 and the first power transmission unit 112 of this embodiment are separately formed and assembled into the washing shaft 110, they can be formed as a solid body according to the processing method.

The dehydrating shaft 120 also includes a center hole 121 for the shaft unit 111 to be penetratingly connected. On an outer circumference of the dehydrating shaft 120, a key 120*a* is formed to transmit the rotational force to the dehydrating tub 12 (FIG. 1). The second power transmission unit 122 is formed integrally with the dehydrating shaft 120. However, in the same manner as the first power transmission unit 112, the second power transmission unit 122 and the dehydrating shaft 120 may be separately formed and assembled later.

At the first power transmission unit 112 and the second power transmission unit 122, the first guide groove 113 and the second guide groove 123 are respectively formed to face each other. The first and the second guide grooves 113 and 123 are formed in an arc shape respectively along the circumferences of the washing shaft 110 and the dehydrating shaft 120, and disposed concentrically with respect to axial centers of the washing shaft 110 and the dehydrating shaft 120.

In addition, first stoppers 113*a* and 123*a* and second stoppers 113*b* and 123*b* are formed at both ends of the first guide groove 113 and the second guide groove 123, respectively. The first and the second guide grooves 113 and 123 each have a semicircular sectional shape and are symmetrically positioned between the first power transmission unit 110 and the second power transmission unit 120.

According to the above structure, when the two guide grooves 113 and 123 correspond to each other, the space having a circular sectional shape is formed between the guide grooves 113 and 123. The power transmission member 130 having a spherical form is received in the circular space.

The space formed by the two guide grooves 113 and 123 is varied in length in accordance with relative rotated positions of the washing shaft 110 and the dehydrating shaft 120 by rotation of the washing shaft 110. When the power transmission member 130 contacts the first stopper 113*a* or the second stopper 113*b* of the first guide groove 113 and the first stopper 123*a* or the second stopper 123*b* of the second guide groove 123 while moving in the circular-sectional space having a variable length, the washing shaft 110 and the dehydrating shaft 120 are connected by the power transmission member 130. In this state, the dehydrating shaft 120 is rotated subject to unidirectional rotation of the washing shaft 110.

As described above, power transmission between the washing shaft 110 and the dehydrating shaft 120 is accomplished as the power transmission member 130 interconnects the washing shaft 110 and the dehydrating shaft 120 in accordance with the relative rotated positions of the washing shaft 110 and the dehydrating shaft 120. This will be explained in greater detail hereinafter.

Although, in this embodiment, the power transmission member 130 has a global shape and the first and the second guide grooves 113 and 123 have a semicircular shape to correspond to the power transmission member 130, the present invention is not limited to this arrangement. Therefore, the sectional shapes of the power transmission member 130, and the first and the second guide grooves 113 and 123 may be in other various forms. But, as shown, the power transmission member 130 and the first and the second guide grooves 113 and 123 have the sectional shapes corresponding to each other so as to minimize the motional resistance while the power transmission member 130 is moving along the guide grooves 113 and 123. Especially when the power transmission member 130 has the global shape and the guide grooves 113 and 123 have the semicircular sectional shape to correspond to the shape of the power transmission member 130, as in the embodiment of the present invention, the power transmission member 130 can efficiently move.

Additionally, lubricant oil having predetermined viscosity may be applied to the first and the second guide grooves 113 and 123. Therefore, friction between the power transmission member 130 and the guide grooves 113 and 123 can be reduced, thereby relieving an impact between the power transmission member 130 and stoppers 113*a*, 113*b*, 123*a* and 123*b*.

Hereinafter, a power transmission processes performed by the power transmission device 100 between the washing shaft 110 and the dehydrating shaft 120 will be explained in detail with reference to FIG. 4 to FIG. 6.

Figure 4:
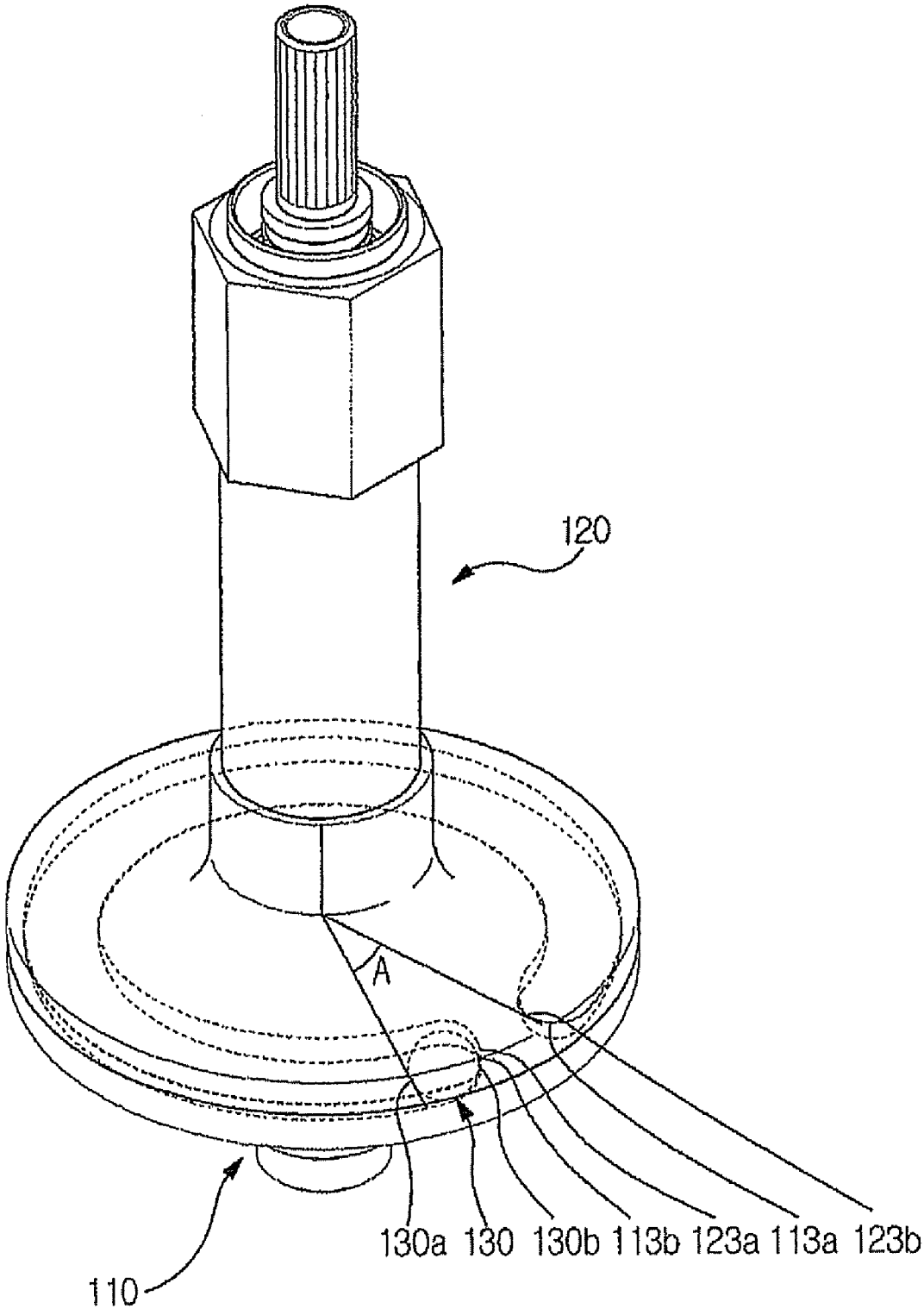
FIG. 4 is an operational state view of the power transmission device in which a first guide groove is phase-corresponded to a second guide groove so that the first and the second guide grooves face each other.

In FIG. 4, the first power transmission unit 112 and the second power transmission unit 122 are disposed without difference of the rotated positions such that the first guide groove 113 and the second guide groove 123 correspond in an axial direction. In this state, therefore, the power transmission member 130 is able to move along the entire first and the second guide grooves 113 and 123.

Here, the first and the second guide grooves 113 and 123 can perfectly correspond to the axial direction because the guide grooves 113 and 123 have the same degree of central angles. However, the central angles of the two guide grooves 113 and 123 are not necessarily the same, but can instead be formed differently. Here, it is noted that a rotatable range of the washing shaft 110 out of engagement with the dehydrating shaft 120 is increased and decreased according to the central angles of the first and the second guide grooves 113 and 123.

More specifically, in a state where the dehydrating shaft 120 is stopped, as the first guide groove 113 is moved by the washing shaft 110 being rotated in one direction by the driving motor 16 (FIG. 1), the space formed by the first and the second guide grooves 113 and 123 facing in the axial direction is gradually reduced. Accordingly, when an overlapped length between the first and the second guide grooves 113 and 123 is minimized, the power transmission member 130 moving along the space finally meets the first stopper 113*a* or the second stopper 113*b* of the first guide groove 113 and the first stopper 123*a* or the second stopper 123*b* of the second guide groove 123. Therefore, a rotational force of the washing shaft 110 can be transmitted to the dehydrating shaft 120.

Thus, the washing shaft 110 is capable of independently rotating clockwise and counterclockwise within a predetermined rotatable angle range, out of connection with the dehydrating shaft 120, and performing a washing operation in this state.

Figure 5:
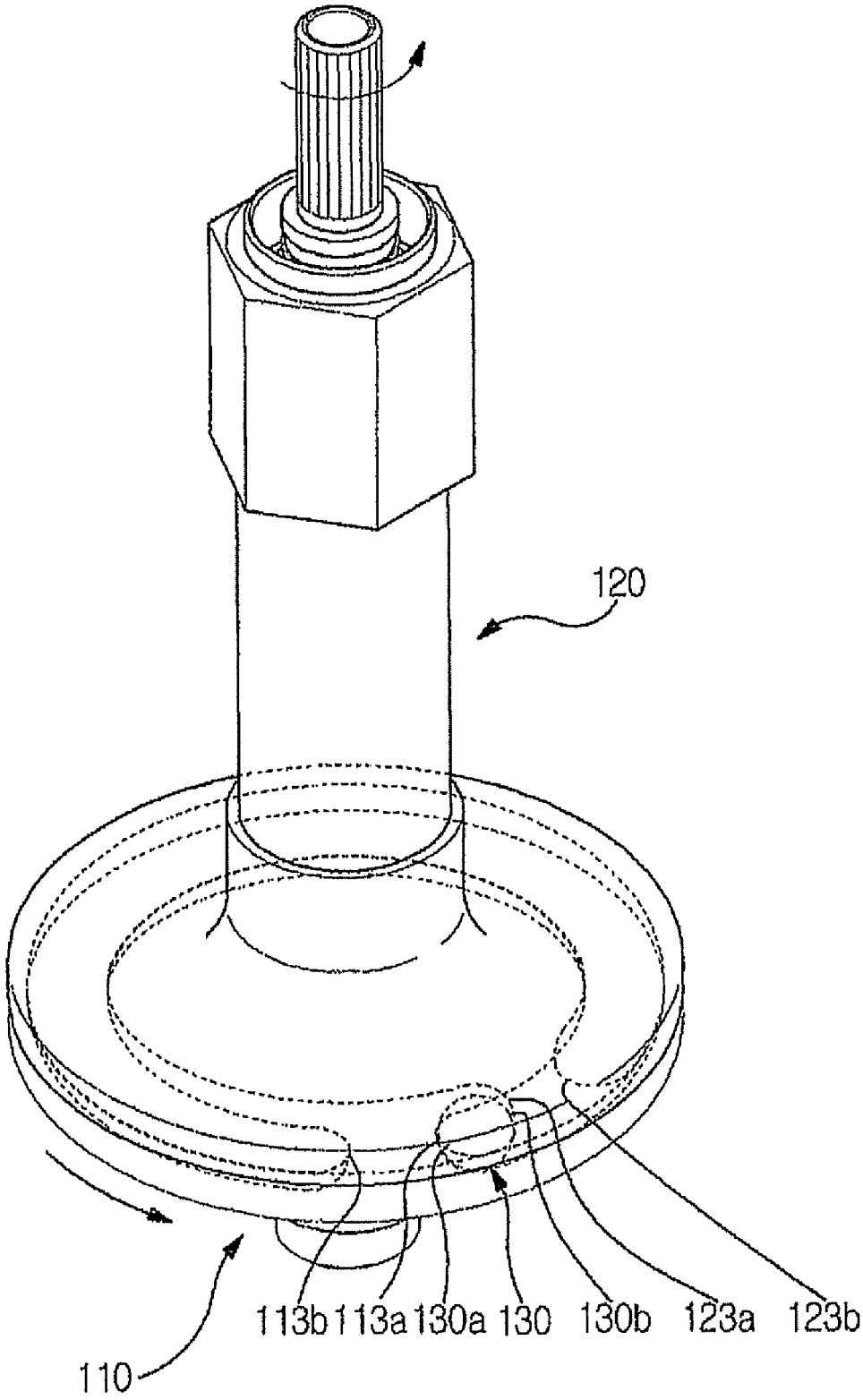
FIG. 5 is an operational state view of the power transmission device in which a washing shaft of FIG. 4 is rotated counterclockwise and connected to a dehydrating shaft.

Referring to FIG. 5, the washing shaft 110 is rotated counterclockwise until left side 130*a* and right side 130*b* of the power transmission member 130 are brought into contact with the first stopper 113*a* of the first guide groove 113 and the first stopper 123*a* of the second guide groove 123, respectively.

In this state, the dehydrating shaft 120 is restricted to the counterclockwise rotation of the washing shaft 110 by the power transmission member 130 and the pair of first stoppers 113*a* and 123*a*. Therefore, the rotational force of the washing shaft 110 is transmitted to the dehydrating shaft 120 and accordingly the washing shaft 110 and the dehydrating shaft 120 are rotated at the same angular velocity.

The above operational state refers to a dehydrating mode wherein laundry received in the dehydrating tub 12 is dehydrated as the dehydrating tub 12 and the pulsator 13 are rotated at the same angular velocity. More particularly, when the washing shaft 110 is rotated at a high speed by the driving motor 16, the dehydrating shaft 120 is rotated along with the washing shaft 110, thereby rotating the dehydrating tub 12 at a high speed. According to this, water contained in the laundry can be separated by a centrifugal force and discharged to the outside of the dehydrating tub 12.

Figure 6:
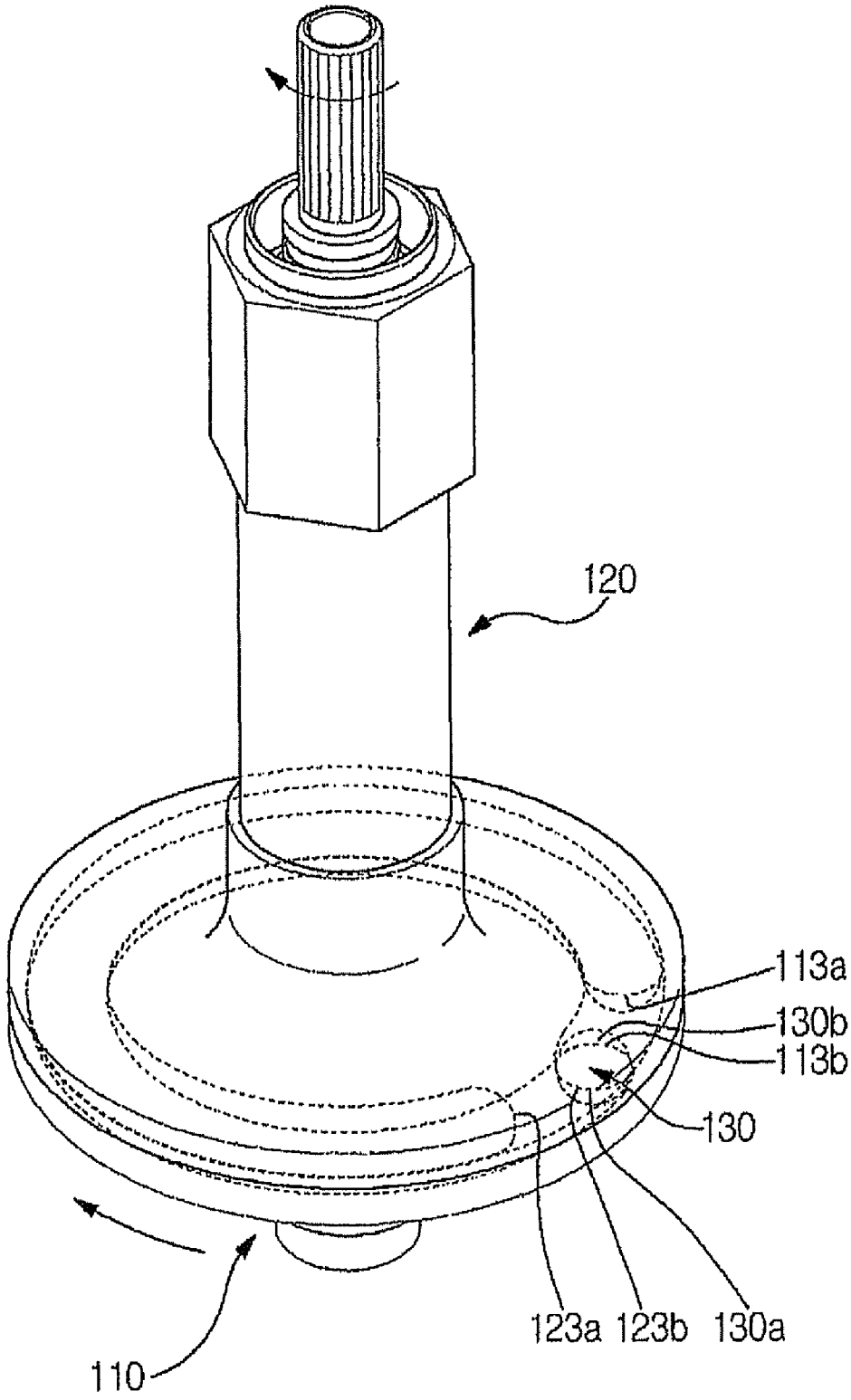
FIG. 6 is an operational state view in which the washing shaft of FIG. 4 is rotated clockwise and connected to the dehydrating shaft.

According to FIG. 6, as the washing shaft 110 in the states of FIG. 4 and FIG. 5 is continuously rotated clockwise until the second stopper 123*b* of the second guide groove 123 and the second stopper 113*b* of the first guide groove 113 respectively contact the left side 130*a* and the right side 130*b* of the power transmission member 130, the dehydrating shaft 120 in the stopped state is restricted to the clockwise rotation of the washing shaft 110 and thereby rotated at the same angular velocity as the washing shaft 110.

Generally, the pulsator 13 is rotatable clockwise and counterclockwise within a range of 360° in consideration of entanglement of the laundry. Thus, when the driving motor 16 is operated by a control unit (not shown) such that the washing shaft 110 is rotated clockwise and counterclockwise independently from the dehydrating shaft 120 within a range to rotate the pulsator 13, a washing mode is maintained wherein the rotational force of the driving motor 16 is transmitted only to the pulsator 13 through the washing shaft 110 while the dehydrating shaft 120 is in the stopped state.

On the other hand, when the washing shaft 110 further rotates in the certain direction beyond the rotatable range thereof, the washing mode is converted to the dehydrating mode in which the washing shaft 110 and the dehydrating shaft 120 are rotated simultaneously.

Thus, conversion between the washing mode and the dehydrating mode can be achieved by controlling the relative rotated positions of the washing shaft 110 and the dehydrating shaft 120 by rotating the washing shaft 110 by the driving motor 16 such that power transmission between the washing shaft 110 and the dehydrating shaft 120 is controlled intermittently.

Next, calculation of the rotatable angle allowing unidirectional rotation of the pulsator 13 (FIG. 1) by the independent rotation of the washing shaft 110 will be explained with reference to FIGS. 4 to 6.

In a standard state, the first guide groove 113 and the second guide groove 123 correspond to each other in the axial direction, as shown in FIG. 4. Presuming that the central angles of the first and the second guide grooves 113 and 123 are the same, a central angle formed from the first stopper 113*a* of the first guide groove 113 and the second stopper 123*b* of the second guide groove 123 to the left side 130*a* of the power transmission member 130 is referred to as A°. Under such conditions, when the first power transmission unit 112 of the washing shaft 110 is rotated counterclockwise by 360-A° from the standard state of FIG. 4, the dehydrating shaft 120 is rotated subject to the counterclockwise rotation of the washing shaft 110 as shown in FIG. 5, thereby enabling the dehydrating operation. When the washing shaft 110 is rotated clockwise by 360-A° from the standard state of FIG. 4, the dehydrating shaft 120 is restricted to the clockwise rotation of the washing shaft 110 as shown in FIG. 6, thereby enabling the dehydrating operation.

Therefore, when the washing shaft 110 independently rotates with respect to the dehydrating shaft 120 until the operation mode is converted to the washing mode, the unidirectional rotational range of the washing shaft 110 becomes the total of the rotational ranges in FIG. 5 and FIG. 6. That is, the rotatable angle is 720-2A°.

As can be understood from the above, the rotatable range of the washing shaft 110 to enable the washing operation is increased and decreased according to variation of the central angle formed at a region where the first and the second guide grooves 113 and 123 are not formed. Therefore, in order to secure favorable rotation of the pulsator 13 (FIG. 1) by the washing shaft 110 during the washing operation, the angle A is minimized such that the independent rotatable range of the washing shaft 110 is secured.

As apparent from the above description, the washing machine according to the embodiment of the present invention is capable of controlling power transmission between a washing shaft and a dehydrating shaft in accordance with a rotated position of the washing shaft rotated by a driving motor, without a dedicated electric device for mode conversion between a washing course and a dehydrating course. As a result, the production cost can be reduced, and reliability of the power transmission control is improved.

In addition, since a buoyancy generating structure controlling power transmission in a water tub can be omitted, a space between the water tub and a dehydrating tub can be reduced, accordingly saving wash water. Additionally, as the structure of the power transmission device is simplified, the size of the power transmission device can be reduced, consequently reducing the height of the washing machine.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A washing machine comprising:

a dehydrating tub;

a pulsator which is rotatably mounted in the dehydrating tub;

a motor which rotates the dehydrating tub and the pulsator;

a washing shaft which transmits a rotational force of the motor to the pulsator;

a dehydrating shaft which intermittently receives the rotational force of the washing shaft;

a power transmission member which is moved according to the rotation of the washing shaft, thereby controlling intermittent power transmission between the washing shaft and the dehydrating shaft; and a first guide groove and a second guide groove which are respectively formed at the washing shaft and the dehydrating shaft so as to guide movement of the power transmission member.

2. The washing machine according to claim 1, wherein a length of an overlapped part between the first guide groove and the second guide groove is varied according to rotated positions of the washing shaft and the dehydrating shaft, and the power transmission member intermittently controls power transmission between the washing shaft and the dehydrating shaft according to the length of the overlapped part.

3. The washing machine according to claim 2, wherein the power transmission member transmits the rotational force of the washing shaft to the dehydrating shaft when the length of the overlapped part of the guide grooves is a minimum, and does not transmit the rotational force when the overlapped length is greater than the minimum.

4. The washing machine according to claim 1, wherein the first guide groove and the second guide groove each comprise a first stopper and a second stopper formed at both respective ends thereof, and the power transmission member transmits the rotational force of the washing shaft to the dehydrating shaft when the power transmission member is disposed between the first or second stoppers of the first guide groove and the first or second stoppers of the second guide groove.

5. The washing machine according to claim 1, wherein the washing shaft and the dehydrating shaft comprises a first power transmission unit and a second power transmission unit, respectively, the first and second power transmission units each having a flange, the first and second power transmission units facing each other, and the first guide groove and the second guide groove are disposed at facing surfaces of the first power transmission unit and the second power transmission unit.

6. The washing machine according to claim 1, wherein the first guide groove and the second guide groove each have an arc shape.

7. The washing machine according to claim 1, wherein the power transmission member has a spherical shape.

8. A washing machine comprising:

a dehydrating tub;

a pulsator which is rotatably mounted in the dehydrating tub;

a motor which rotates the dehydrating tub and the pulsator;

a washing shaft which transmits a rotational force of the motor to the pulsator;

a dehydrating shaft which intermittently receives the rotational force of the washing shaft; and a power transmission member which is moved according to the rotation of the washing shaft, thereby controlling intermittent power transmission between the washing shaft and the dehydrating shaft, wherein the dehydrating shaft comprises a pair of stoppers, and the power transmission member transmits the rotational force of the washing shaft to the dehydrating shaft when the washing shaft is rotated with the power transmission member restricted by any one of the stoppers, and does not transmit the rotational force when the washing shaft is rotated with the power transmission member separated from the stoppers.

9. A washing machine comprising:

a dehydrating tub;

a pulsator which is rotatably mounted in the dehydrating tub;

a dehydrating shaft connected to the dehydrating tub;

a driving motor which generates a rotational force; and a power transmission device which includes a washing shaft connected between the driving motor and the pulsator and the dehydrating shaft, and to connect the washing shaft with the dehydrating shaft according to unidirectional rotation of the washing shaft, wherein the power transmission device comprises a first guide groove and a second guide groove respectively formed at the washing shaft and the dehydrating shaft, and a power transmission member which is received in a space formed between the first and the second guide grooves and is moved according to the unidirectional rotation of the washing shaft, thereby connecting the washing shaft with the dehydrating shaft.

10. The washing machine according to claim 9, wherein the first guide groove and the second guide groove each comprise a first stopper and a second stopper formed at respective ends thereof, and the power transmission device transmits the rotational force of the washing shaft to the dehydrating shaft when disposed between the first or second stoppers of the first guide groove and the first or second stoppers of the second guide groove by the unidirectional rotation of the washing shaft.

11. A washing machine comprising:

a dehydrating tub;

a pulsator which is rotatably mounted in the dehydrating tub;

a dehydrating shaft connected to the dehydrating tub;

a driving motor which generates a rotational force; and a power transmission device which includes a washing shaft connected between the driving motor and the pulsator and the dehydrating shaft, and to connect the washing shaft with the dehydrating shaft according to unidirectional rotation of the washing shaft, wherein the washing shaft and the dehydrating shaft comprise a first power transmission unit and a second power transmission unit, respectively, the first and second power transmission units each having a flange and facing each other, and the first guide groove and the second guide groove are disposed at facing surfaces of the first power transmission unit and the second power transmission unit.

12. A washing machine comprising:

a dehydrating tub;

a pulsator which is rotatably mounted in the dehydrating tub;

a driving motor which generates a rotational force;

a power transmission device which includes a washing shaft connected between the driving motor and the pulsator and a dehydrating shaft connected to the dehydrating tub, and connects the washing shaft with the dehydrating shaft according to a unidirectional rotation of the washing shaft; and a control unit which controls the driving motor such that the power transmission between the washing shaft and the dehydrating shaft is intermittently controlled according to the rotation of the washing shaft, wherein the power transmission device interrupts the power transmission when the washing shaft is rotated within a predetermined rotatable range, and transmits the rotational force from the washing shaft to the dehy drating shaft when the washing shaft is rotated in beyond the rotatable range.

13. The washing machine according to claim 12, wherein the control unit controls the driving motor such that the washing shaft is rotated clockwise and counterclockwise within the rotatable range.

14. The washing machine according to claim 12, wherein the control unit controls the driving motor such that the washing shaft is rotated in beyond the rotatable range.

* * * * *

UNITED STATES PATENT AND TRADEMARK OFFICE

CERTIFICATE OF CORRECTION

PATENT NO. : 8,033,143 B2
APPLICATION NO. : 12/368640
DATED : October 11, 2011
INVENTOR(S) : Tae Kil Kim et al.

It is certified that error appears in the above-identified patent and that said Letters Patent is hereby corrected as shown below:

First Page, Item (75) (Inventors), Column 1, Line 2 - 3, delete "Seong Kwun Ahn," and insert --Seung Kwun Ahn,--, therefor.

Signed and Sealed this
Fourteenth Day of February, 2012

David J. Kappos

David J. Kappos
*Director of the United States Patent and Trademark Office*